United States Patent [19]

Ariga et al.

[11] 4,320,324

[45] Mar. 16, 1982

[54] FLAT FLUORESCENT LAMP

[75] Inventors: Kazuo Ariga, Tokyo; Mitunari Yoshida, Yokohama, both of Japan

[73] Assignee: Stanley Electric Co., Ltd., Tokyo, Japan

[21] Appl. No.: 107,356

[22] Filed: Dec. 26, 1979

[30] Foreign Application Priority Data

Dec. 30, 1978 [JP] Japan ..... 53-182657[U]

[51] Int. Cl.[3] ..... H01J 61/30; H01J 61/42

[52] U.S. Cl. ..... 313/493; 313/318

[58] Field of Search ..... 313/493, 485, 220, 249, 313/331, 318

[56] References Cited

U.S. PATENT DOCUMENTS

| | | | |
|---|---|---|---|
| 1,877,932 | 9/1932 | Meyer et al. | 313/514 X |
| 2,177,710 | 10/1939 | Gordon | 313/484 |
| 2,201,390 | 5/1940 | Delaney | 313/493 |
| 2,933,634 | 4/1960 | Lederer | 313/249 X |
| 3,286,118 | 11/1966 | Vause et al. | 313/318 |
| 3,903,447 | 9/1975 | Young et al. | 313/493 |

FOREIGN PATENT DOCUMENTS

| | | | |
|---|---|---|---|
| 2803462 | 8/1978 | Fed. Rep. of Germany | 313/220 |
| 182926 | 7/1922 | United Kingdom . | |
| 400746 | 11/1933 | United Kingdom . | |
| 402747 | 12/1933 | United Kingdom . | |
| 656163 | 8/1951 | United Kingdom . | |
| 669036 | 3/1952 | United Kingdom . | |
| 980142 | 1/1965 | United Kingdom . | |
| 1533395 | 11/1978 | United Kingdom . | |

*Primary Examiner*—PalmerC. Demeo

*Attorney, Agent, or Firm*—Frishauf, Holtz, Goodman & Woodward

[57] ABSTRACT

A flat type fluorescent lamp comprises a pair of rectangular dish-shaped halves connected together to form a rectangular hollow body, and discharge electrodes disposed at both ends of the rectangular body. Voltage supply terminals for the electrodes and an exhaust pipe for exhausting or substituting another gas for the air in the fluorescent lamp are situated at one end only of the rectangular body.

8 Claims, 7 Drawing Figures

FLAT FLUORESCENT LAMP

BACKGROUND OF THE INVENTION

The invention relates to a fluorescent lamp with discharge electrodes at both of its ends, and more particularly to a flat type fluorescent lamp which is rectangular in overall shape and which is formed by connecting rectangular dish-shaped halves.

The fluorescent lamp of the prior art is, in general, constructed in such a manner that it has discharge electrodes at both its ends, irrespective of the shape of the lamp. Voltage supply terminals are mounted on the stems which have exhaust pipes for facilitating the mounting of these electrodes. After a discharge electrode is connected between the terminals of each stem, a stem is mounted to each end of the fluorescent lamp. Therefore, the fluorescent lamp has a stem and voltage supply terminals projecting from each of its ends. Since a base is connected to the ends, it is necessary that the terminals for mounting the sockets project from both ends of the fluorescent lamp.

When such a fluorescent lamp serves as a projecting type display lamp used in corridors and so on, the sockets must be formed on the wall side and on the passage side. Even if a socket mounting frame is used, it is frequently the case that the base is exposed or the frame of the socket mounting portion is extremely wide at the passage side. Thus, the appearance will not be very attractive. Further, since the fluorescent lamp is a bayonet socket type, the mounting condition is unstable unless a spring biasing force is exerted on the socket toward the lamp. Thus, the lamp has the disadvantage of requiring a more complicated construction for providing the spring biasing force; further, the construction of the frame itself is complicated, and the number of manufacturing processes increases, resulting in higher cost.

The present invention was made to overcome these defects, and a major object of the invention is to provide a flat type fluorescent lamp in which the voltage supply terminals are provided at only one end of the lamp.

Another object of the invention is to provide a fluorescent lamp suitable for use as a projecting type display lamp of the kind used in corridors and so on.

SUMMARY OF THE INVENTION

In accordance with the present invention, a flat type fluorescent lamp comprises a pair of generally rectangular, dish-shaped halves each having a flat surface, said dish-shaped halves facing either other and being connected together at peripheral portions thereof to form a hollow body; a stem disposed at only one end of the connected hollow body, the stem containing an exhaust pipe and voltage supply terminals; a first discharge electrode coupled to the voltage supply terminals and being in the hollow body at said one end; a second discharge electrode mounted in the hollow body at the opposite end of the hollow body; a pair of lead wires connected at one end to the second discharge electrode, the lead wires extending to the side of the stem around the outside marginal area of the dish-shaped halves; and a base having two pairs of pin electrodes, the base being located in the vicinity of the stem; the other ends of the lead wires and the voltage supply terminals being connected to respective ones of the pin electrodes.

These objects are attained in accordance with the invention in which a pair of rectangular halves are made to face each other for connection, the overall shape of the fluorescent lamp is rectangular, a mount with an exhaust pipe and voltage supply terminals is attached to only one end, the other end faces a discharge electrode of said mount by attaching the discharge electrode to lead wires, the lead wires are gathered at the mounting terminal side for connecting them to the base, the mounting portion of the socket is disposed at one end of the fluorescent lamp, the installment of the fluorescent lamp is easy, the socket usually required at the passage side for a projecting display lamp for corridors is unnecessary, the lamp is only inserted into the socket disposed on the wall side, no additional exposed wiring is necessary and the overall appearance is improved.

DETAILED DESCRIPTION OF THE INVENTION

Figure 1:
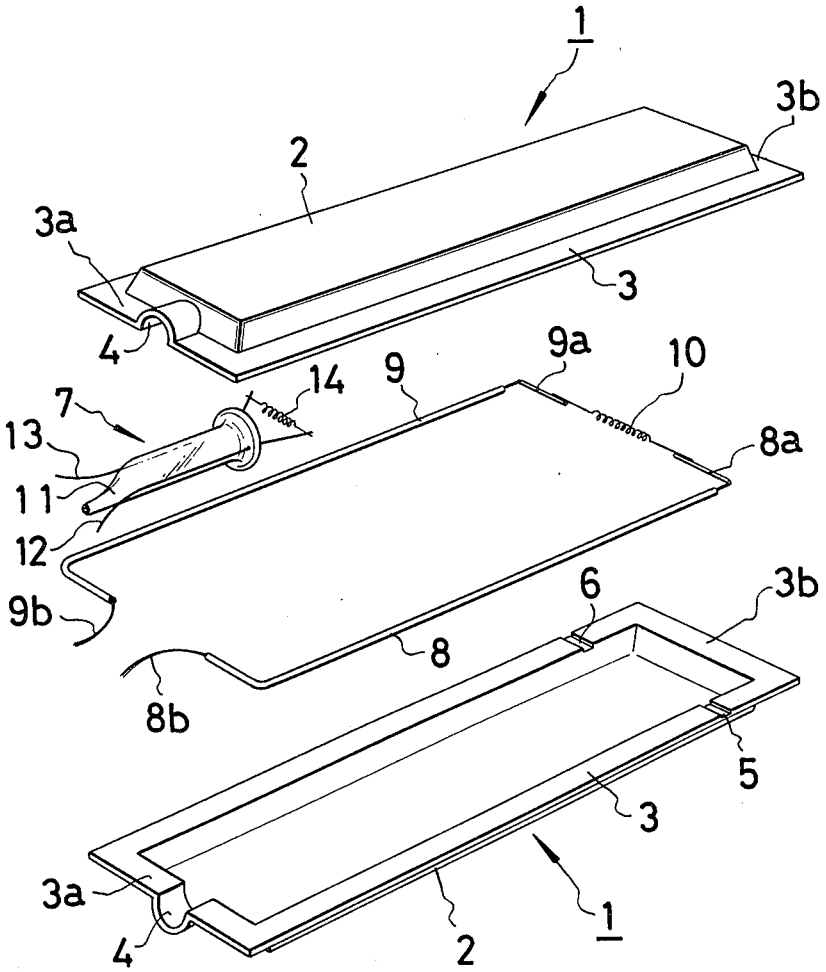
FIG. 1 is an exploded perspective view illustrating the flat fluorescent lamp of the invention.
Figure 2:
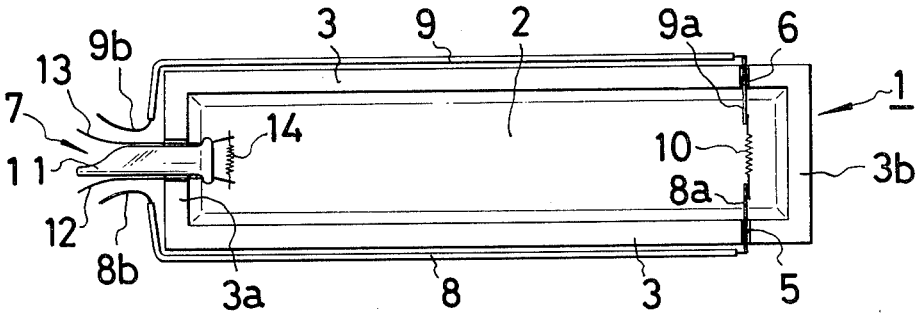
FIG. 2 is a front view illustrating the wiring of the flat type fluorescent lamp in which one of the dish-shaped halves is cut away.

In the embodiment shown in the drawings, 1 designates dish-shaped halves made of glass which are formed in a generally rectangular shape. The flat type fluorescent lamp is formed by facing the dish-shaped halves toward each other and connecting them together. Since the dish-shaped halves 1 are similar, the construction of only one of the dish-shaped halves 1 will be explained. The dish-shaped half includes a projecting portion 2, forming a rectangular discharging tube part, and a flange 3 around projecting portion 2. A recess 4 for engaging with a stem, to be explained further hereinafter, is formed in the flange portion 3*a* of one of the short sides of the rectangular body. Grooves 5, 6 are formed in the flange 3 and cross both of the long sides at points close to the other short side flange portion 3*b*.

Before a pair of dish-shaped halves 1 of such construction are connected together, a stem engages with the recess 4, and the front ends 8*a*, 9*a* of the lead wires 8, 9 are placed in the grooves 5, 6. The front ends 8*a*, 9*a* are made of dumet wire, or an alloy of iron, nickel, or chrome. The remaining length of each lead wire 8, 9 disposed outside the lamp is made of copper. An exhaust pipe 11 is integrally formed with the aforementioned stem 7 which is made of glass. A pair of voltage supply terminals 12, 13 comprising dumet wires, or the like, are mounted thereon. A discharge electrode 14 is mounted across the front ends of the voltage supply terminals 12, 13 opposite a discharge electrode 10 which is connected across lead wire ends 8*a*,9*a*. The stem 7 and the lead wires 8, 9 are disposed at predetermined places. A sealing material such as soda glass or frit glass is applied to the flanges 3 of the pair of dish-shaped halves 1, where they are in contact with each other, to keep the flanges 3 impermeable and thus form a flat type fluorescent lamp which is generally of rectangular form. It is of course understood that sealing material is also applied to the recess 4, in which is disposed the stem 7, and to the grooves 5, 6, in which are disposed the lead wires 8, 9, for rendering these parts impermeable.

After the flanges 3 are sealed, the inner air is either discharged or substituted with an inert gas through the exhaust pipe 11 which is closed thereafter. The lead wires 8, 9 are attached to the body along the outside of the flanges 3 toward the stem 7. The other ends of the lead wires 8*b*, 9*b* are collected at the same side of the lamp as the voltage supply terminals 12, 13.

Figure 3:
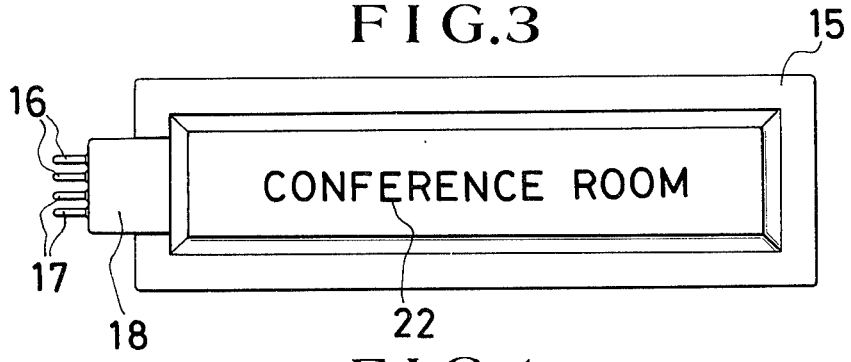
FIG. 3 is a front view illustrating the finished flat type fluorescent lamp.
Figure 5:
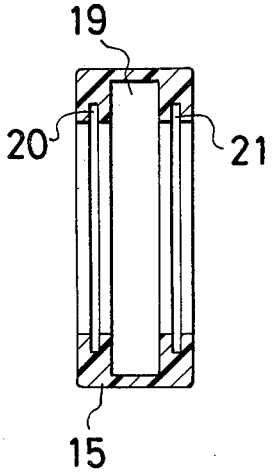
FIG. 5 is an enlarged sectional view taken along the line V—V of FIG. 4.
Figure 6:
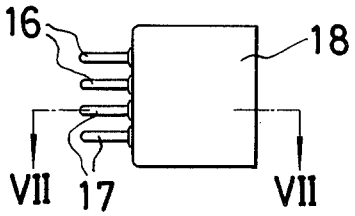
FIG. 6 is an enlarged front view of the base of the flat type fluorescent lamp of the invention.
Figure 7:
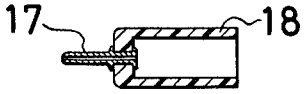
FIG. 7 is a sectional view taken along the line VII—VII of FIG. 6.

The connected and sealed flanges 3 are covered with an ornamental frame 15 (FIGS. 3–5) made of a synthetic resin or rubber. The voltage supply terminals 12, 13 are connected to a base 18 (FIGS. 3 and 6) and to a pair of pin electrodes 16, 17. The base 18 is securely attached to one side of the fluorescent lamp by an adhesive such as epoxy resin.

Figure 4:
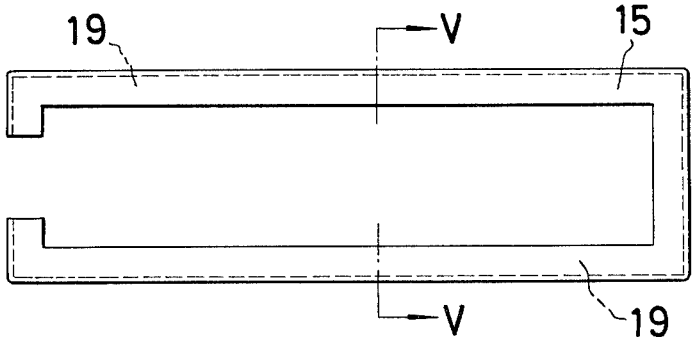
FIG. 4 is a front view illustrating a frame in which the flat type fluorescent lamp of the invention is installed.

The frame 15 is rectangular so as to correspond to the shape of the fluorescent lamp (see FIG. 4). Grooves 19 (see FIG. 5) is formed on the inner surface of frame 15, securely engaging with the flanges 3 of the fluorescent lamp. Grooves 20, 21 (FIG. 5) are also formed in frame 15 on both sides of the groove 19 for receiving a transparent or semi-transparent display plate.

The base 18 is made of insulating materials such as melamine resin or urea resin. Two pairs of pin electrodes 16, 17 each consisting of conductive metal material such as brass or alloys including nickel or chrome, are mounted on the base 18. The pin electrodes are made of hollow pipe materials. The voltage supply terminals 12, 13 are inserted in the pin electrodes 16, and the free ends of the lead wires 8, 9 are respectively inseted in the pin electrodes 17. The sections of these voltage supply terminals projecting from the pin electrodes are soldered, and the unnecessary parts of them are cut away. The flat type fluorescent lamp of the invention is manufactured in this manner. Since the fluorescent lamp itself has a flat light-emitting surface, the display part 22 such as "CONFERENCE ROOM" can be directly displayed on it, or alternatively, a desired colored display can be attained using other suitable display plates.

As has been described, the flat type fluorescent lamp is quite useful as a display lamp since it is manufactured by connecting dish-shaped halves and therefore direct display on a flat surface is possible. The exhaust pipe and the voltage supply terminals are collected only at one end of the flat type fluorescent lamp so that no projecting portions are formed at the other end of the lamp. Thus, electrical wiring and exchange of new lamps are easy and the appearance is improved when this lamp is used as a projecting type display lamp of the type used in corridors. Further, since no comparatively heavy parts, such as the base and the voltage supply terminals, are included at the other end, that is, the front or free end of the projecting display lamp, the load exerted by the projecting end is less and the center of gravity is shifted toward the mounting side. Thus the fluorescent lamp of the invention is advantageous in that the mounting conditions are stable.

What is claimed is:

1. In combination, a flat type fluorescent lamp and a frame therefor, comprising:

a pair of generally rectangular, dish-shaped halves (1) each having a projecting flat surface portion (2) and a peripheral flange portion (3) surrounding said projecting portion (2), said dish-shaped halves (1) facing each other and being connected together at said peripheral flange portions thereof to form a generally rectangular hollow body have two opposed short ends and two opposed longer sides;

a stem (7) disposed at only one of said short ends of the connected rectangular hollow body, said stem (7) containing an exhaust pipe (11) and voltage supply terminals (12,13);

a first discharge electrode (14) coupled to said voltage supply terminals (12,13) and being in said rectangular hollow body at said one short end thereof;

a second discharge electrode (10) mounted in said hollow body at the opposite short end of said rectangular hollow body;

a base (18) having two pairs of pin electrodes (16,17), said base being located only at said one short end of said rectangular hollow body in the vicinity of the stem (7);

a pair of lead wires (8,9) connected at one end to said second discharge electrode (10), said lead wires (8,9) extending from said second discharge electrode (10) to said base (18), said lead wires (8,9) extending outside of said rectangular hollow body and along and adjacent to the outside marginal area of said flange portions (3) of the dish-shaped halves (1) over at least a major portion of length of said longer sides of said rectangular hollow body and over a portion of said one short end of said rectangular hollow body;

the other ends of said lead wires (8,9) and said voltage supply terminals (12,13) being connected to respective ones of said pin electrodes of said base (18); and a generally rectangular frame (15) surrounding substantially the complete periphery of said rectangular hollow body, said frame (15) having a groove (19) formed on the inner surface thereof for receiving and engaging said flanges (3) therein, the portion of said lead wires (8,9) which extend along said flange portions being received in said groove (19) of said frame (15).

2. The combination flat type fluorescent lamp and frame of claim 1 wherein said flanges are sealed with soda glass.

3. The combination flat type fluorescent lamp and frame of claim 1 wherein said flanges are sealed with frit glass.

4. The combination flat type fluorescent lamp and frame of claim 1 wherein a recess (4) is formed on one of the short sides of the flange portion of said dish-shaped halves, and the stem (7) is set in the recess (4) and sealed therein.

5. The combination flat type fluorescent lamp and frame of claim 1 or 4 comprising grooves (5,6) formed in respective long sides of the flange portion near the short side of the flange portion, and conductive metal members set in respective grooves and sealed therein, said conductive metal members being connected to said second discharge electrode (10) and said lead wires being connected to said conductive metal members.

6. The combination flat type fluorescent lamp and frame of claim 1 wherein a display is directly effected on the flat surface of the fluorescent lamp.

7. The combination flat type fluorescent lamp of claim 1 wherein said frame comprises at least one further groove (20,21) adjacent said first mentioned groove (19) for receiving a display plate means adjacent at least one projecting flat surface portion (2) of said rectangular hollow body.

8. The combination flat type fluorescent lamp of claim 1 wherein said frame (15) has an opening therein for said base (18) to pass through so that said pin electrodes (16,17) extend from said base (15).

* * * * *